United States Patent [19]

van Staden

[11] 4,336,931

[45] Jun. 29, 1982

[54] POOL TOY

[75] Inventor: Renier J. van Staden, Johannesburg, South Africa

[73] Assignee: Charles Lonstein, Johannesburg, South Africa

[21] Appl. No.: 66,802

[22] Filed: Aug. 15, 1979

[30] Foreign Application Priority Data

Aug. 16, 1978 [ZA] South Africa ..... 78/4646

[51] Int. Cl.[3] ..... A63G 31/00

[52] U.S. Cl. ..... 272/1 B; 441/136

[58] Field of Search ..... 272/1 B, 56, 1 R, 130; D21/236, 237, 69, 70, 74, 75, 157, 165; 9/311, 347, 348, 310 F, 310 J; 46/87, 88, 89, 90; 5/449, 327, 455, 441

[56] References Cited

U.S. PATENT DOCUMENTS

| | | | |
|---|---|---|---|
| D. 33,763 | 12/1900 | Meinecke | D6/201 |
| D. 162,940 | 4/1951 | Drury | D21/165 |
| D. 255,966 | 7/1980 | Stadel | 5/449 |
| 587,224 | 7/1897 | McKelvey | 5/441 |
| 726,164 | 4/1903 | Hogan et al. | 5/449 |
| 1,343,357 | 6/1920 | Eggers | 5/449 |
| 1,810,556 | 6/1931 | Fenton | 9/311 |
| 2,013,410 | 9/1935 | Howland | 272/1 B |
| 2,423,890 | 7/1947 | Hurt | 46/90 X |
| 2,574,046 | 11/1951 | Logan | 5/449 X |
| 2,688,207 | 9/1954 | Hurt | 272/1 B X |
| 3,204,951 | 9/1965 | Grain | 272/1 B |
| 3,528,116 | 9/1970 | Fenar | 272/1 B |
| 4,099,773 | 7/1978 | Chang | 272/56 |
| 4,161,794 | 7/1979 | Darnfors | 5/455 X |
| 4,288,071 | 9/1981 | Glickson | 272/130 X |

FOREIGN PATENT DOCUMENTS

| | | | |
|---|---|---|---|
| 283611 | 6/1966 | Australia | 5/441 |
| 215848 | 5/1924 | United Kingdom | 272/1 B |

OTHER PUBLICATIONS

Fun Sun, Inc.—Folsom, Calif., Pool Flotation Device. Doughboy Industries, Inc., New Richmond, Wisc., Inflatables of Vinylite Brand Plastic, The Saturday Evening Post, Jun. 9, 1951.

*Primary Examiner*—Richard J. Apley
*Assistant Examiner*—Arnold W. Kramer
*Attorney, Agent, or Firm*—Pennie & Edmonds

[57] ABSTRACT

A pool toy comprising a buoyant body having a central part on which a rider is adapted to be seated, and two end parts, the end parts being raised relatively to the central part and each being of greater volume than the central part.

9 Claims, 3 Drawing Figures

POOL TOY

BACKGROUND OF THE INVENTION

This invention relates to a toy intended for use in a pool as a buoyant body which can be ridden by a person seated astride it, the toy having a high degree of stability so that the rider can fairly freely change position on the toy without falling off it, and can also paddle about the pool on it with good control of his movements. The toy lends itself to a number of games in which one or more players take part, including many variants of games such as polo.

SUMMARY OF THE INVENTION

According to the invention a pool toy comprises a buoyant body having a central part on which a rider is adapted to be seated and two end parts, the end parts being raised relatively to the central part and each being of greater volume than the central part.

The body is preferably flexible and in plan view is elongate, the end parts being bulbous. It may conveniently be symmetrical about both a central longitudinal plane and a central transverse plane.

DESCRIPTION OF A PREFERRED EMBODIMENT

Figure 1:
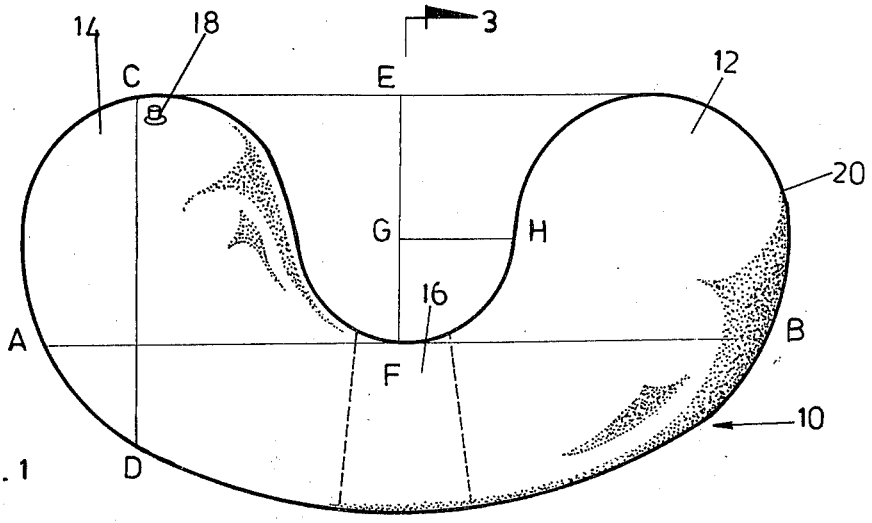
FIG. 1 is a side elevation view of a pool toy of the invention.

The pool toy illustrated comprises an elongate body, curved in a generally arcuate fashion and having a central part 16 on which a person is adapted to be seated and two raised end parts 12,14 that are bulbous both in side view and plan view relatively to the central part 16. The three parts merge smoothly into each other at their junctions, the approximate positions of which are seen in dash lines in FIGS. 1 and 2. The body 10 is formed from two identical flat sheets of a flexible, tough and air-impermeable material such as certain plastics, joined together along a seam line 20 by welding or a similar known process. A particularly suitable material is a two-layer laminated polyvinyl chloride. A valve 18 of a known type is provided on one side for inflation and deflation of the envelope formed by the two sheets, each of which is kidney-shaped in outline.

Figure 2:
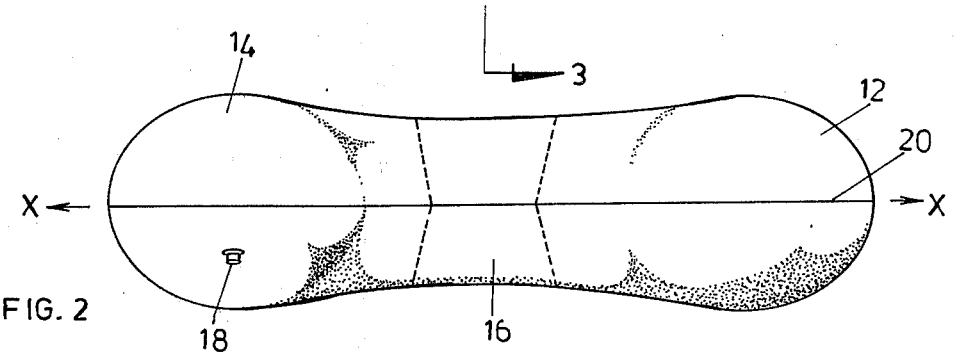
FIG. 2 is a plan view of the toy of FIG. 1.
Figure 3:
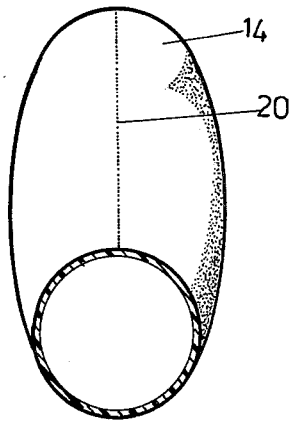
FIG. 3 is a sectional view along the plane 3—3 in FIG. 1.

The body has, as is seen in the drawings, the general shape of a curved sausage with enlarged ends. The general longitudinal axis of each enlarged end is inclined away from the vertical, and these axes normally diverage upwardly and away from the central part 16 as shown in FIG. 1. The central part 16 has in side view a concave upper surface on which a person may be seated, and a convex undersurface curved in more than one direction, as will become apparent by referring to FIGS. 1 and 3, which is largely submerged in use. Since the body is flexible, it bends to some extent when ridden in the water, the end parts 12 and 14 moving close to the rider's torso and providing relatively large buoyant volumes ahead of and behind him, so that a tendency to tip backwards or forwards is counteracted. Since tipping would require the submersion of one of the end parts, whose cross-section area in the plane of the water's surface increases with tipping, the tendency is strongly resisted and in fact the rider may lie on the toy almost horizontally and yet retain a high degree of stability. Tipping in the sideward directions is also counteracted as a result of the geometry of the toy and in particular the fact that the central seat part 16 is lower than the end parts and because the relatively large volumes of the end parts resist submersion. The rider thus retains great freedom of movement and after only slight practice is able to paddle the toy about at will without being concerned about sliding off it. In fact he is able to jump into the water astride the toy from the side of a swimming pool or from even higher elevations without becoming unseated.

Note that the toy illustrated is symmetrical both about its central longitudinal plane (X—X in FIG. 2) and its central transverse plane (3—3 in FIG. 1).

Preferred dimensions for a version suitable for children in the age group from about 12 to about 16 are (with reference to the uninflated form of the toy and as marked in FIG. 1): A–B=900 mm, C–D=430 mm, E–F=150 cm and G–H=120 cm.

ALTERNATIVE EMBODIMENTS

The device may also be manufactured from substances such as foam, preferably of a resilient plastics, in which case inflation is unnecessary.

I claim:

1. A pool toy comprising a buoyant body of a substantially U-shaped outline with a center part and end parts, said center part being narrower than said end parts, the center part defining a seat for a rider and the end parts being bulbous in shape in both side and plan views, said end parts forming buoyant portions on opposite sides of said seat, the end parts being raised and normally divergent and in a self-sustaining condition with respect to the center part, each being of greater volume than the center part of the body, said body having a lower portion convexly curved in more than one direction and said body being symmetrical about its central longitudinal plane and its central transverse plane, whereby said pool toy resists tipping in the backwards, forwards and sideward directions as a result of the end parts resisting submersion.

2. The toy of claim 1 made of a flexible material.

3. The toy of claim 1 which is inflatable.

4. The pool toy according to claim 1, 2 or 3 wherein the buoyant body is elongate.

5. The pool toy according to claim 1, 2 or 3 wherein the buoyant body is made from two sheets of a plastics material, welded together along their edges.

6. The toy of claim 5 in which the plastics material is laminated polyvinyl chloride.

7. The pool toy of claim 5 wherein the sheets comprise a flexible material, each sheet being kidney-shaped in outline and wherein a valve is provided in one of the sheets whereby the pool toy is inflated and deflated.

8. The toy of claim 7 in which the sheets are flat.

9. The pool toy of claim 1 or 2 wherein the buoyant body comprises a resilient plastic foam.

* * * * *

UNITED STATES PATENT AND TRADEMARK OFFICE

CERTIFICATE OF CORRECTION

PATENT NO. : 4,336,931

DATED : June 29, 1982

INVENTOR(S) : Renier J. van Staden

It is certified that error appears in the above—identified patent and that said Letters Patent is hereby corrected as shown below:

Column 1, line 55, "diverage" should read -- diverge --.

Signed and Sealed this

*Thirty-first* Day of *August 1982*

[SEAL]

*Attest:*

GERALD J. MOSSINGHOFF

*Attesting Officer*

*Commissioner of Patents and Trademarks*